United States Patent [19]

O'Cheskey et al.

[11] 3,972,815

[45] Aug. 3, 1976

[54] MIXING APPARATUS

[75] Inventors: Theodore H. O'Cheskey, Whittier; Carroll C. Bunker, Covina; Hugh T. Edwards, Jr., Whittier, all of Calif.

[73] Assignee: United States Filter Corporation, Whittier, Calif.

[22] Filed: Jan. 9, 1975

[21] Appl. No.: 539,838

[52] U.S. Cl. ..... 210/219; 210/221 M; 261/93

[51] Int. Cl.[2] ..... B03D 1/00

[58] Field of Search ..... 209/169; 210/44, 219, 210/221 M; 261/93, 121 R

[56] References Cited

UNITED STATES PATENTS

| | | | |
|---|---|---|---|
| 2,393,976 | 2/1946 | Daman et al. | 210/44 X |
| 2,767,965 | 10/1956 | Daman | 261/93 X |
| 2,875,897 | 3/1959 | Booth | 209/169 |
| 3,278,170 | 10/1966 | Moritz | 261/93 X |
| 3,491,880 | 1/1970 | Reck | 210/221 M |
| 3,503,593 | 3/1970 | Nelson | 261/93 X |
| 3,547,811 | 12/1970 | McWhirter | 261/93 X |
| 3,647,069 | 3/1972 | Bailey | 210/221 M |

*Primary Examiner*—Charles N. Hart
*Assistant Examiner*—Robert H. Spitzer
*Attorney, Agent, or Firm*—Christie, Parker & Hale

[57] ABSTRACT

Mixing apparatus includes a tank having an upright draft tube extending down below an operating level of liquid contained in the tank. An upright rotary shaft extending through the draft tube rotates an impeller below the draft tube for pulling gas and water into a submerged mixing zone. A propeller at the bottom of the shaft rotates in the bottom of a tubular upright still-well below the draft tube for pulling liquid upwardly from the bottom of the tank toward the impeller. A perforated, conical shaped shroud extends downwardly and outwardly from the bottom of the draft tube around the top of the impeller blades. Gas bubbles generated by the rotating impeller flow upwardly through the holes in the shroud. A plurality of spaced apart and radially extending vanes on top of the shroud constantly direct the flow pattern of the bubbles in a radial direction away from the mixing unit toward the edges of the tank.

19 Claims, 3 Drawing Figures

MIXING APPARATUS

BACKGROUND

This invention relates to apparatus for mixing and dispersing gas in the form of fine bubbles in a body of liquid in a tank by rotating an impeller to pull the gas and liquid into a mixing zone below a submerged shroud where the bubbles are formed and dispersed in an upward radial flow pattern.

The invention can be used in various types of aeration apparatus, such as, to add air to sewage, or remove dissolved oxygen from water by mixing an inert gas with the water to displace the oxygen.

The apparatus also can be used in flotation processes in which solid particles in a slurry, or immiscible liquid droplets in an emulsion, are separated from the main body of the liquid. The small bubbles selectively attach themselves to the particles or droplets to be suspended, and provide buoyancy to raise them to the surface of the liquid. The material to be separated is taken from the surface of the tank in the form of a froth. Chemical reagents can be added to the liquid to enhance film-forming and bubble adherence to improve separation efficiency. Reagents that induce a froth are called "frothers". Those that assist in the selective separation of one solid from another in a liquid are called "depressers", "deflocculating agents" and "collectors", depending on the specific function performed by the reagent.

A good discussion of mixing apparatus on which the present invention is an improvement is in *Chemical Engineering*, June 8, 1964, pp 165–220.

The following U.S. patents also describe flotation apparatus on which the present invention is an improvement:

| | |
|---|---|
| 953,746 | Hoover |
| 1,976,956 | MacLean |
| 2,274,658 | Booth |
| 2,494,602 | Wright |
| 2,626,052 | Carbonnier |
| 2,875,897 | Booth |
| 3,393,802 | Logue et al |
| 3,393,803 | Daman et al |
| 3,647,069 | Bailey |
| 3,775,311 | Mook et al |

One prior art flotation apparatus, on which the present invention is an improvement, includes an upright draft tube extending into a body of liquid contained in a flotation cell or tank, and an inverted bowl-shaped hood, or shroud, below the draft tube. The shroud is substantially imperforate, except for a series of radially extending notches formed at spaced apart intervals around the inner periphery (point of maximum elevation) of the shroud adjacent the draft tube. An upright rotary shaft extends down through the draft tube and rotates an impeller located under the shroud. The space under the shroud forms a mixing zone where gas and liquid are subjected to turbulence by the impeller blades. The action of the impeller forms small bubbles which flow outwardly from under the hood through the notches around the top of the hood. The bubbles circulate upwardly in the liquid and attach themselves to material to be removed by flotation. The configuration of the shroud also causes the gas-liquid mixture to be driven down toward the bottom of the tank. This flow pattern tends to sweep the bottom clean of solids and elevate them to a point where they attach themselves to the bubbles and are floated away.

One disadvantage of this prior art mixing apparatus is that the impeller cannot be set deep enough in large tanks to create sufficient circulation to sweep the bottom clean and still produce the necessary surface flow pattern for the air bubbles to effectively remove material by flotation. This prior art unit also has an undesirable tendency to generate foam which flows in a rotary pattern and stagnates around the draft tube. The rotary flow pattern tends to collect material to be floated in the corners of the cell. The stagnation causes a build up or collection of foam in the center of the cell where the foam either dissipates or is "folded under" by the flow pattern. Therefore, even though contaminants are floated to the surface, a good part of them are reentrained in the liquid and have to be floated again. The present invention avoids these problems by generating a flow pattern of air bubbles in a radial direction outwardly from the mixing apparatus toward the edges of the cell where skimmers can remove the material floated to the surface.

Flotation processes commonly use several side-by-side tanks or cells through which the treated liquid flows serially. It is common to have a liquid level gradient from cell to cell, with the level of liquid in the cell nearest the inlet being the highest, and the levels in each cell thereafter being progressively lower. The level in each cell is commonly set by adjusting the elevation of weirs on opposite sides of each cell. The present invention provides a convenient means for adjusting the gas-to-liquid ratio in each cell which, in turn, provides a good way of complementing the use of adjustable weirs to adjust the liquid level gradient from cell to cell.

SUMMARY OF THE INVENTION

Briefly, the mixing apparatus of this invention includes a tank for holding a volume of liquid, and an upright draft tube disposed in the tank and extending below an operating level of the liquid in the tank. An upright shaft is disposed within the draft tube, and an impeller secured to the shaft is located below the draft tube. An outwardly and downwardly extending shroud is secured to the lower end of the draft tube and extends circumferentially away from the draft tube and around the upper edges of the impeller blades. A plurality of upright vanes are secured to the top surface of the shroud. The vanes extend radially outwardly from the axis of the draft tube. A plurality of holes extend through the shroud between the vanes. Gas is admitted into the draft tube to be mixed with the liquid in the tank, and the shaft and impeller are rotated to force liquid outwardly from the impeller toward the underside of the shroud to entrain gas bubbles in the liquid and create a circulation pattern of the bubbles passing through the holes in the shroud and directed radially outwardly toward the edges of the tank.

This combination of the perforated shroud and the radial vanes generates a surface flow pattern of foam which continuously moves in a radial direction from the center of the tank toward the edges of the tank. When used in flotation apparatus, the radially moving foam is constantly skimmed over the weirs, and new foam is constantly pulled in place of it. This action improves the effectiveness of each skimmer blade in removing floated material from each cell and greatly eliminates reentrainment of the floated material.

In a preferred form of the invention, a propeller is secured to the rotary shaft below the impeller. The propeller rotates in the bottom portion of an upright, tubular still-well. Rotation of the propeller pulls liquid upwardly from the bottom of the tank toward the impeller. The still-well and propeller increase the velocity of liquid at the bottom of the cell which improves the ability of the mixing unit to sweep clean the bottom of the cell. The still-well and propeller also improve the pumping action of the mixing unit which, in turn, improves the flow rate, or recirculation, of the liquid through the impeller.

When the mixing unit of this invention is used for flotation, it preferably has an overflow weir, and a skimmer which sweeps foam on the surface over the weir. A gas inlet valve above the tank is adjusted to control the flow rate of gas into the draft tube to vary the amount of gas mixed with the liquid in the tank. An increase in the air to liquid ratio raises the operating level of liquid in the tank. In a flotation unit containing a number of cells in series, the draft tube for each cell has its own adjustable gas inlet valve. In use, the valves can be adjusted independently of each other to produce a gradient in the levels of the liquid in each cell. Thus, the gradient need not be adjusted by the more cumbersome procedure of adjusting the level of each weir in the cells.

These and other aspects of the invention will be more fully understood by referring to the following detailed description and the accompany drawing.

DETAILED DESCRIPTION OF THE PREFERRED EMBODIMENTS

Figure 1:
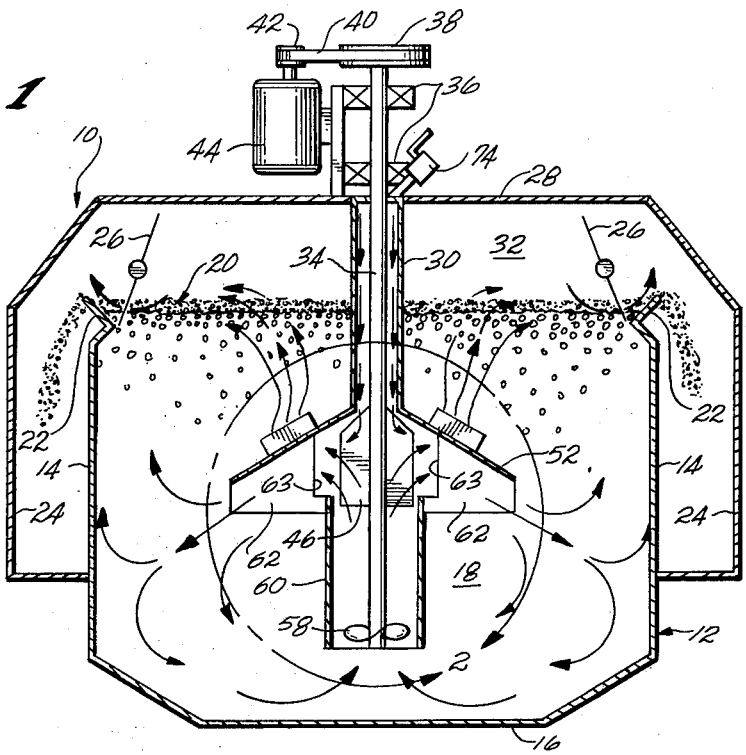
FIG. 1 is a schematic, cross-sectional elevation view showing the mixing apparatus embodying the preferred improvement of this invention.

Referring to FIG. 1, a mixing cell 10 includes a tank 12 with opposite side walls 14 and a bottom 16. The tank holds a body of liquid 18 at an operating level 20 just below a pair of weirs 22 extending along the upper edges of the side walls on opposite sides of the tank. Preferably, the weirs are adjustable in elevation to adjust the operating level of the liquid 18. A separate trough 24 is secured to the outside of the tank under each weir 22 to catch effluent skimmed from the tank over the weirs. A pair of elongated skimmers 26 on opposite sides of the tank above the weirs skim effluent over the weirs. The skimmers extend a major portion of the length of the tank. A cover 28 encloses the top of the tank. The cover 28 may or may not seal the top of the tank.

A vertical draft tube 30 extends from the tank cover down into the center of the tank, terminating below the operating level 20 of the liquid in the tank. The top of the draft tube may be secured to the cover by welding so that the gas space 32 above the operating level of the liquid is sealed from the draft tube. Alternately, the draft tube may not be welded, or otherwise sealed, to the tank cover.

A vertically extending rotary shaft 34 is coaxially disposed within the draft tube and supported at its upper end by a bearing 36 which supports the shaft within the draft tube. A driven pulley 38 is secured to the upper end of the shaft above the bearings 36 and is driven by a belt 40 secured around the driven pulley and a drive pulley 42 turned by an electric motor 44 mounted above the tank cover.

An impeller 46 is secured to an intermediate portion of the shaft 34 to be rotatable about the same vertical axis as the longitudinal axis of the shaft. In some instances the impeller includes eight equidistantly spaced apart, outwardly extending blades 48 (shown best in FIG. 2) secured at their inner edges to the shaft. The number of blades varies with the size of the unit. The blades also may be slipped onto the shaft as a removable unit. Each blade preferably has a flat, rectangular lower portion, and a triangular upper portion with an inclined top edge 50 which tapers upwardly toward the central rotary shaft 34. As shown best in FIG. 1, the impeller blades are located at an intermediate depth below the operating level of the liquid 18 in the cell.

A perforated, conical shaped shroud 52 is secured, say by welding, around the lower portion of the draft tube to extend outwardly and downwardly away from the draft tube around the upper edges of the impeller blades. When the shroud 52 is viewed in vertical cross-section, as in FIG. 1, the shroud extends downwardly and outwardly from the draft tube along an inclined path without any substantial curvature. The preferred angle of inclination of the shroud is 20° relative to the horizontal, although results are good using an angle of inclination in the range of about 10° to 30°.

Figure 2:
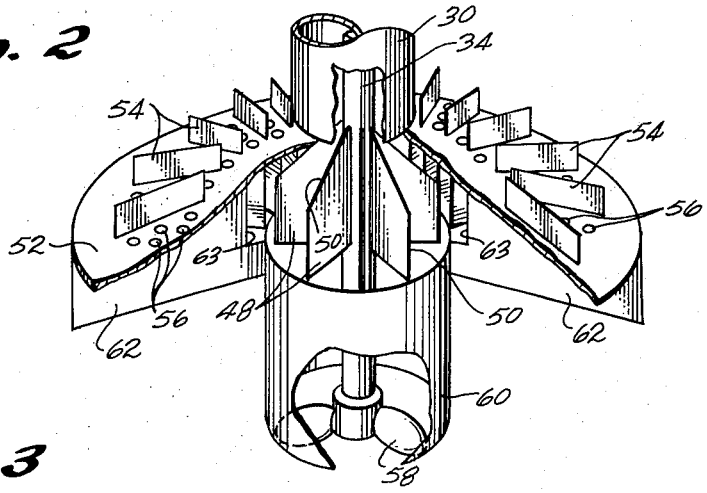
FIG. 2 is a fragmentary perspective view, partly broken away, showing an enlarged view of the apparatus within the circle 2 of FIG. 1.

As shown best in FIG. 2, a series of rectangular shaped upright vanes 54 are secured to the top edge of the shroud, say by welding. The vanes are circumferentially spaced apart around the entire top surface of the shroud and extend radially outwardly from the vertical axis of the draft tube and rotating shaft. As shown best in FIG. 1, the vanes extend along an intermediate portion of the shroud when the shroud is viewed in vertical cross-section.

A plurality of spaced apart holes 56 extend through the portions of the shroud between the vanes. A separate set of holes is located between each pair of vanes, so that the holes extend circumferentially all the way around the shroud. The holes are also located on the shroud at the point of highest pressure created on the shroud by the centrifugal action of the impeller.

As shown best in FIG. 1, a propeller 58 is secured, say by welding, to the lower end of the rotary shaft 34. Preferably, the propeller 58 is located one-propeller diameter above the bottom 16 of the cell. An upright, tubular still-well 60 located below the draft tube 30 surrounds the lower portion of the rotary shaft 34 and the propeller 58, terminating in the vicinity of the propeller. The still-well 60 preferably has a diameter greater than that of the draft tube 30, and is aligned coaxially with the draft tube. The still-well 60 is supported by a plurality of circumferentially spaced apart and radially extending stator vanes 62. As shown best in FIG. 1, the stator vanes are generally trapezoidal in shape, with the top edge of each trapezoid being secured to the bottom surface of the shroud, and the inner edge of the trapezoid being secured to the top outer surface of the draft tube. The inner edge of each stator vane has a notched section 63 adjacent the impeller blades. The outer edge of each stator vane extends to the outer periphery of the shroud.

In use, liquid is admitted to the tank 12 and its operating level is controlled by any suitable means, such as those described below with reference to FIG. 3. If the apparatus is used for flotation separation, liquid to be treated flows into the cell through a submerged inlet (described below and shown in FIG. 3) and the skimmers 26 sweep foam and separated material, or contaminants, over the weirs and into the troughs. Treated liquid having a lower solids content leaves the tank through a submerged outlet. A typical application for flotation separation is to separate crude oil from water. In this instance, air bubbles generated by the mixing apparatus float the crude oil to the surface of the water where the crude oil is skimmed off and into the troughs 24.

The electric motor 44 rotates the shaft 34 and impeller 46 to force the liquid to flow outwardly away from the axis of rotation of the impeller and toward the undersurface of the shroud 52. The rotating impeller and propeller reduce the pressure at the lower end of the still-well 60 so that water is drawn upwardly through the still-well and into the eye of the impeller. Gas is pulled down the draft tube and mixed with the liquid driven by the impeller. The space under the shroud forms a mixing zone where gas and liquid are subjected to turbulence by the rotating impeller blades. As the liquid is driven outwardly from the impeller it flows between the adjacent stator vanes 62 and then flows upwardly through the holes in the shroud and radially outwardly from the shroud between the vanes 54 above the shroud. Small gas bubbles are formed by the action of the impeller blades, and these bubbles attach themselves to the material removed by flotation, or else they saturate the liquid with the gas used, and also displace any gas dissolved in the incoming liquid. The arrows shown in FIG. 1 illustrate the flow pattern of the gas bubbles and the liquid in the tank.

The angular inclination of the shroud 52 affects the recirculation pattern of air bubbles discharged from the bottom side of the shroud. As to those air bubbles which are discharged through the holes in the shroud, the angular inclination of the shroud affects the desired surface flow pattern of the bubbles moving toward the skimmers. The preferred angle of 20°, referred to above, produces a desirable radial flow pattern of bubbles generated by the impeller, and it also produces a good recirculation pattern in the lower portion of the cell. The preferred angle of the shroud produces a recirculation pattern which minimizes "upwelling" in the corners of the cell. "Upwelling" is a turbulent upward flow of liquid in the corners of the cell which pulls the foam down into the cell from the surface and upsets the desired quiescent condition of the surface foam.

The vanes 54 and holes 56 in the shroud combine to generate a surface flow pattern of foam which continuously moves in a radial direction away from the mixing apparatus toward the edges of the tank. As the foam continuously moves radially toward allows skimmers 26 it is skimmed over the weirs 22 and new foam is pulled in place of it. This radially moving foam pattern increases the effectiveness of the skimmer blades in removing the floated material, and also greatly reduces the possibility of reentrainment of the floated material. The hole pattern being located at the point of highest pressure created by the impeller effectively dissipates this high energy to produce a good dispersion of fine air bubbles upwardly through the holes 56 and away from the shroud, rather than the air bubbles stagnating or being dissolved. The hole pattern also allows the fine air bubbles to move in a direction upwardly and outwardly toward the vanes 54 which direct the air bubbles toward the edges of the tank. Further, the hole pattern greatly minimizes flow patterns which cause upwelling in the corners of the cell, thus producing a more quiescent surface foam condition.

The preferred mixing unit contains a set of five equidistantly spaced apart holes 56 between each pair of vanes 54. The number of holes is not critical as long as the hole pattern produces a good dispersion of the entrained air bubbles through the shroud and the vanes to produce the desired radial flow of bubbles with the desired quiescent surface condition and minimal stagnation and upwelling. The preferred sizes of the holes are from ½ inch to 1¼ inches in diameter, depending upon the size of the mixing unit. In large cells, say 5000 gpm, the size of the holes will be about 1¼ inches in diameter. For smaller cells, say those having a flow rate of less than 500 gpm, the holes in the shroud are about ½ inch in diameter.

The vanes on top of the shroud direct the flow of air bubbles, which pass through the holes in the shroud, radially outwardly away from the mixing unit. The vanes thus prevent a rotary pattern of surface foam and resulting stagnation near the draft tube. The centrifugal action of the impeller has the tendency to cause bubbles leaving the impeller to flow in a swirling rotary pattern, but the vanes direct the air bubbles flowing through the shroud along a flow path directed upwardly and radially from the mixing apparatus to prevent the swirling pattern from taking place. There is no critical limitation on the height of the vanes, other than they be high enough to divert the flow pattern of bubbles upwardly and outwardly toward the edges of the tank in a radial flow pattern.

The propeller 58 and still-well 60 greatly reduce the possibility of "short-circuiting", i.e. the passage of solids through the cell without being floated. The addition of the still-well 60 around the propeller 58 increases the efficiency of the pumping action of the propeller. In use, the propeller and still-well combine to pull liquid off the bottom of the cell and direct it toward the impeller at a flow rate such that the entire volume of the cell is recirculated through the mixing apparatus about 15 times per minute. The propeller being located one-propeller diameter above the bottom of the cell results in an increased velocity of the liquid sweeping the bottom of the cell, resulting in a more efficient flotation of any solids that might otherwise tend to collect on the bottom of the cell.

The stator vanes 62 help disperse the air-rich liquid (including air bubbles not passing through the holes in the shroud) in a recirculating pattern directed radially outwardly and downwardly from the mixing apparatus.

Figure 3:
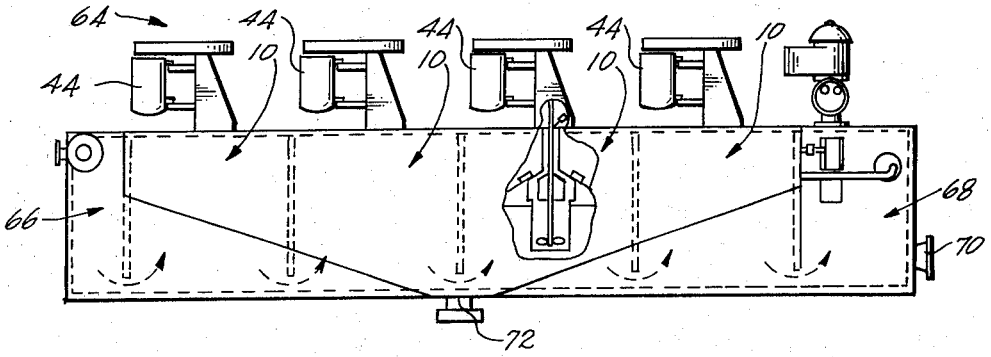
FIG. 3 is a schematic elevation view, partly broken away, showing several of the mixing units of FIG. 1 connected in series to provide an improved flotation separator.

FIG. 3 shows a flotation separation cell 64 which includes four of the flotation cells 10 in series, although fewer or more of the cells 10 can be used in series without departing from the scope of the invention.

In use, liquid with material or contaminants to be separated by flotation is added to an inlet well 66 adjacent the first mixing cell in the series. The liquid flows into the first mixing cell through an opening in the lower portion of the end wall of the first cell adjacent the well 66. The liquid is mixed with gas due to the action of the impeller as described above. Some of the material to be floated is buoyed to the surface and swept away by the skimmers in the first mixing cell. The remaining liquid and contaminants flow from the first mixing cell to the second mixing cell through an opening in the bottom portion of the common end wall which separates the first mixing cell from the second. The liquid in the second cell is mixed with gas by a separate impeller as described above, and additional matter is buoyed to the surface and removed by the skimmers. The same flotation action occurs in the third and fourth cells, and by the time the liquid leaves the fourth cell, the bulk of the matter to be separated by flotation has been removed. Treated liquid flows through an outlet in the bottom of the wall in the fourth cell and into a discharge well 68 at the downstream end of the flotation separation apparatus. Treated liquid flows out a discharge pipe 70 in the bottom of the discharge well 68. The material removed by flotation is skimmed off by the rotating skimmer blades 26 over the adjustable weirs 22 and discharged from the troughs 24 through a drain pipe 72.

The advantage of the present invention is that each flotation cell connected in series as just described can be independently adjusted to provide the optimum gas-liquid ratio for mixing to achieve the maximum separation efficiency. This is accomplished by a separate adjustable gas inlet valve 74 sealed through the top portion of the draft tube in each cell. The air admitted to each draft tube from outside the cell passes through the gas inlet valve. Preferably, each valve is an adjustable ball valve in which the amount of air flowing into the draft tube can be adjusted independently of the air flowing through the valves in the other cells.

The amount of air added to each cell also controls the level of the liquid in the cell. It is common in such flotation cells for the operating level of the liquid in the first cell to be higher than that in the remaining cells, and for the level to be on a gradient which decreases progressively from the first cell to the fourth cell. Since the ball valves 74 can be used to adjust the amount of air admitted to each cell independently of the other cells, they provide an easily adjustable control for setting the level gradients from cell to cell. This complements the use of adjustable weirs in controlling the liquid level gradient from cell to cell.

We claim:

1. Mixing apparatus comprising a tank for holding a volume of liquid; and upright draft tube disposed within the tank for extending below an operating level of the liquid; an upright shaft disposed within the draft tube; an impeller blade secured to the shaft at a location below the operating level of the liquid and below the extent of the draft tube; an outwardly and downwardly inclined shroud located at the lower end of the draft tube and extending circumferentially away from the lower end of the draft tube and above the impeller blade, the shroud having an undersurface facing the impeller blade and being in substantially uninterrupted fluid communication therewith so that an upwardly circulating pattern of bubbles formed in the liquid by rotation of the impeller blade impinges directly on the undersurface of the shroud, the shroud also having a top surface facing away from the impeller blade; a plurality of circumferentially spaced apart upright vanes secured to the top surface of the shroud, the vanes extending radially outwardly from the upright axis of the draft tube; a plurality of holes extending through the shroud between the vanes; means for admitting gas into the draft tube to be mixed with the liquid; and means for rotating the shaft and impeller blade to entrain gas bubbles in the liquid and create a circulation pattern of the bubbles passing upwardly through the holes in the shroud and directed radially outwardly between the vanes and toward the edges of the tank.

2. Apparatus according to claim 1 in which the shroud is generally conical shaped.

3. Apparatus according to claim 2 in which the shroud, when viewed in vertical cross-section, is generally linear, extending on an angle between 10° to 30° relative to the horizontal.

4. Apparatus according to claim 1 including at least about five holes in the shroud between each pair of adjacent vanes, the holes being between about ½ inch to about 1½ inches in diameter.

5. Apparatus according to claim 1 including an upright, generally tubular shaped still-well which is open at both ends, the still-well being in line with the axis of the draft tube and below the impeller, and in which the shaft extends below the impeller and through the still-well, and including a propeller secured to the bottom portion of the shaft below the impeller for drawing liquid upwardly from the bottom portion of the tank through the still-well and forcing it upwardly toward the impeller.

6. Apparatus according to claim 5 in which the propeller is surrounded by the still-well.

7. Apparatus according to claim 5 in which the propeller is located about one-propeller diameter above the bottom of the tank.

8. Apparatus according to claim 5 including a plurality of spaced apart, radially extending, stator vanes secured to the underside of the shroud, and in which the still-well is supported at its top by the stator vanes.

9. Apparatus according to claim 8 in which the top of the still-well is supported by the bottom of the stator vanes to produce a circumferentially extending opening between the bottom of the draft tube and the top of the still-well.

10. Apparatus according to claim 9 in which the impeller is located adjacent the opening between the draft tube and the still-well.

11. Apparatus according to claim 1 in which the holes are located in the shroud at the point of highest fluid pressure created on the shroud by the rotating action of the impeller.

12. Mixing apparatus comprising:

a tank for holding a volume of liquid;

an upright shaft disposed within the tank for extending below an operating level of the liquid;

an impeller blade secured to the shaft at a location below the operating level of the liquid;

an outwardly and downwardly inclined shroud located below the operating level of the liquid and above the impeller blade, the shroud extending circumferentially away from the upright axis of the shaft;

means for admitting gas to the liquid below the shroud to be mixed with the liquid by rotation of the impeller blade;

the shroud having an undersurface facing the impeller blade and being in substantially uninterrupted fluid communication therewith so that an upwardly circulating pattern of bubbles formed in the liquid by rotation of the impeller blade impinges directly on the undersurface of the shroud, the shroud also having a top surface facing away from the impeller blade;

a plurality of circumferentially spaced apart upright vanes secured to the top surface of the shroud, the vanes extending radially outwardly from the upright axis of the shaft;

a plurality of holes extending through the shroud between the vanes; and means for rotating the shaft and the impeller blade to entrain gas bubbles in the liquid and form a circulation pattern of bubbles passing upwardly through the holes in the shroud and directed radially outwardly between the vanes and toward the edges of the tank.

13. Apparatus according to claim 12 including an upright, generally tubular-shaped still-well which is open at both ends, the still-well being located below the impeller, with the shaft extending below the impeller and through the still-well; and a propeller secured to the bottom portion of the shaft below the impeller and within the still-well so the still-well surrounds the propeller, rotation of the shaft rotating the propeller to draw liquid upwardly from the bottom portion of the tank through the still-well to force it upwardly toward the impeller.

14. Apparatus according to claim 13 in which the propeller is located about one-propeller diameter above the bottom of the tank.

15. Apparatus according to claim 12 in which the shroud is generally conical-shaped and, when viewed in vertical cross-section, is generally linear, extending on an angle between 10° to 30° relative to the horizontal.

16. Apparatus according to claim 15 in which the holes are located in the shroud at the point of highest fluid pressure created on the shroud by the rotating action of the impeller.

17. Apparatus according to claim 16 including at least about five holes in the shroud between each pair of adjacent vanes, the holes being between about ½ inch to about 1¼ inches in diameter.

18. Mixing apparatus comprising:

a tank for holding a volume of liquid;

an upright draft tube disposed within the tank for extending below an operating level of the liquid;

an upright shaft disposed within the draft tube;

an impeller blade secured to the shaft at a location below the operating level of the liquid and below the extent of the draft tube;

an outwardly and downwardly inclined shroud secured to the lower end of the draft tube and extending circumferentially away from the draft tube and above the impeller blade, the shroud having an undersurface facing the impeller blade and being in substantially uninterrupted fluid communication therewith so that an upwardly circulating pattern of bubbles formed in the liquid by rotation of the impeller blade impinges directly on the undersurface of the shroud, the shroud also having a top surface facing away from the impeller blade;

a plurality of circumferentially spaced apart upright vanes secured to the top surface of the shroud, the vanes extending radially outwardly from the upright axis of the draft tube;

a plurality of holes extending through the shroud between the vanes;

means for admitting gas into the draft tube to be mixed with the liquid;

an upright, generally tubular-shaped still-well which is open at both ends, the still-well being in line with the axis of the draft tube and below the impeller, the upright shaft extending below the impeller and through the still-well;

a propeller secured to the bottom portion of the shaft below the impeller and within the still-well so the still-well surrounds the propeller; and means for rotating the shaft, impeller blade, and propeller so the propeller will draw liquid upwardly from the bottom portion of the tank through the still-well and force it upwardly toward the impeller, and so the impeller will entrain gas bubbles in the liquid and form a circulation pattern of bubbles passing upwardly through the holes in the shroud and directed radially outwardly between the vanes and toward the edges of the tank.

19. Flotation apparatus comprising:

a first tank having a bottom and an upwardly extending wall;

means for introducing into the first tank a two-phase fluid mixture having a liquid component and an insoluble component;

a first mixing unit for adding and mixing gas with the two-phase fluid to form gas bubbles which attach themselves to some of the insoluble component and buoy it to the surface in the form of a froth, the first mixing unit including an adjustable first gas inlet valve above the operating level of the fluid mixture in the first tank for adjusting the amount of gas added to the fluid to thereby adjust the operating level of the fluid mixture in the first tank;

a second tank adjacent to the first tank and having a bottom and an upwardly extending wall;

an inlet in the second tank connected to the first tank outlet to receive a portion of the two-phase liquid from the first tank;

a second mixing unit for adding and mixing gas with the two-phase liquid in the second tank to form gas bubbles which attach themselves to some of the insoluble component to buoy it to the surface in the form of a froth, the second mixing unit including a second adjustable gas inlet valve for adjusting the amount of gas dispersed in the fluid in the second tank, the second valve being adjustable independently of the first valve so that the operating level of the fluid in the second tank can be adjusted relative to that of the first tank;

each means for adding and mixing gas including an upright draft tube disposed in the tank to extend below the operating level of the fluid in the tank, an upright shaft disposed within the draft tube, an impeller blade secured to the shaft at a location below the operating level of the fluid and below the draft tube, an outwardly and downwardly inclined shroud located at the lower end of the draft tube and extending circumferentially away from the lower end of the draft tube and above the impeller blade, the shroud having an undersurface facing the impeller blade and being in substantially uninterrupted fluid communication therewith so that an upwardly circulating pattern of bubbles formed by rotation of the impeller blade impinges directly on the undersurface of the shroud, a plurality of circumferentially spaced apart upright vanes secured to the top surface of the shroud, the vanes extending radially outwardly from the upright axis of the draft tube, a plurality of holes extending through the shroud between the vanes, and means for rotating the shaft and the impeller to drive fluid outwardly from the impeller and to reduce the pressure at the lower end of the draft tube to below that in the upper end to admit gas into the draft tube to be mixed with the fluid in the tank, the gas inlet valve communicating with the upper end of the draft tube to control the amount of gas admitted to the draft tube in response to rotation of the shaft and the impeller, the rotation of the impeller entraining gas bubbles in the fluid to create a circulation pattern of the bubbles passing upwardly through the holes in the shroud and directed radially outwardly between the vanes and toward the edges of the tank.

* * * * *